US006718850B2

(12) United States Patent
Huang

(10) Patent No.: US 6,718,850 B2
(45) Date of Patent: Apr. 13, 2004

(54) TORQUE TRANSFER MECHANISM FOR SOCKET WRENCH

(76) Inventor: Chin-chen Huang, 12, 41st Road, Industrial Zone, Shitun District, Taichung (TW)

( * ) Notice: Subject to any disclaimer, the term of this patent is extended or adjusted under 35 U.S.C. 154(b) by 115 days.

(21) Appl. No.: 10/025,786

(22) Filed: Dec. 26, 2001

(65) Prior Publication Data

US 2003/0115991 A1 Jun. 26, 2003

(51) Int. Cl.[7] ..... B25B 17/00
(52) U.S. Cl. ..... 81/57.29; 81/62
(58) Field of Search ..... 81/57.29, 57.13, 81/62

(56) References Cited

U.S. PATENT DOCUMENTS 5,058,463 A * 10/1991 Wannop ..... 81/57.29
5,887,493 A * 3/1999 Main ..... 81/57.29
6,070,499 A * 6/2000 Wisbey ..... 81/57.29
6,457,386 B1 * 10/2002 Chiang ..... 81/57.29
6,568,298 B1 * 5/2003 Zinck ..... 81/57.29

* cited by examiner

*Primary Examiner*—James G. Smith
(74) *Attorney, Agent, or Firm*—Rabin & Berdo, P.C.

(57) ABSTRACT

This invention relates an improvement of the torque transfer mechanism exclusively applied to the socket wrench. General speaking, it is an improvement made on the prior art of the socket wrench now popular and available in the tool market. Inside the shank of the socket wrench, it contains a rotary rod connected with a bevel gear which is further meshed with a ring gears on the wrench head. Without changing the profile of the socket wrench, it forms a torque transfer mechanism with robust structure and easy assembly. It provides stable and practical output of the torque for tightening and loosening the bolt.

1 Claim, 3 Drawing Sheets

TORQUE TRANSFER MECHANISM FOR SOCKET WRENCH

BACKGROUND OF THE INVENTION

This invention relates to an improvement of a torque transfer mechanism used exclusively on a socket wrench. The prior art socket wrench constitutes an integrally formed handle, a wrench head and a shank. The wrench head has a vertical housing cavity to receive a torque head. A ratchet and a pair of finger-operated brake drums are outfitted in the housing wall with an adjusting knob located on the top of the torque head, permitting the torque head to carry out a right turn or a left turn, as desired, to tighten and loosen a bolt. The torque input comes from swinging the handle of the socket wrench, and the torque output is vertically applied to the bolt. However, when tightening or loosening the blot, the handle of the socket wrench must be placed perpendicular to the bolt. But in the reciprocated swing, it is very hard for the operator to keep the handle level; in other words, the swing usually results in an up and down oscillation. This oscillation produces unstable contact of the torque head with the bolt in the square recess, as well as an unstabilized torque output. When the bolt does not reach a depth to obtain an adequate holding force, and when the handle is returned for the next turning, the bolt will follow the torque head to return simultaneously to its prior position with no resistance. This is an obvious hardship encountered at the very beginning of a bolt tightening operation. In other cases, the longer the bolt shank the more difficult it will be to maintain a level swing together with a vertical and accurate contact with the bolt. This shortfall causes consumers to dislike using the prior art socket wrench. It is necessary to carry out an improvement on the prior art socket wrench and this is the goal the invention strikes for.

SUMMARY OF THE INVENTION

The object of the invention is to provide an improved torque transfer mechanism for a socket wrench where the shank of the socket wrench contains a torque head inside of a hollow body. The front end of the torque head is locked on a ring gear which meshes with a bevel gear to form a torque transfer mechanism. The torque transfer mechanism of the invention is robust, easy to assemble and the torque output is stable to enhance easy tightening operation of the bolt.

Another object of the invention is provide an improved torque transfer mechanism for the part art of the socket wrench even without any modification in its construction. It is easy to fabricate, assemble, and operate with minor additions of new parts.

The technical characteristics, features and performance of the invention will be explained in great detail by the aid of embodiments illustrated in the attached drawings.

DETAILED DESCRIPTION OF THE EMBODIMENT

Figure 1:
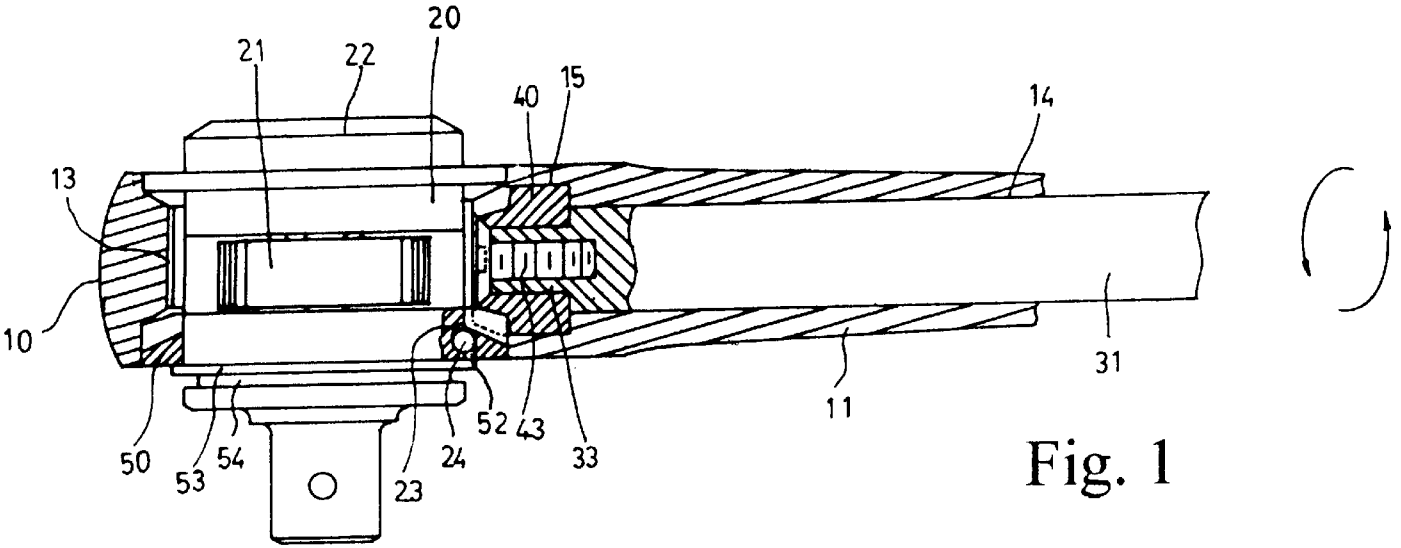
FIG. 1 is schematic diagram showing the complete assembly of the invention.

Please refer to the attached drawings. The torque transfer mechanism for a socket wrench constitutes an integrally formed wrench head 10 and a long extended shank 11. The wrench head 10 has a housing 12 having a vertical cavity to receive a torque head 20. On the inside wall of the housing 12, there is disposed a ratchet 13. A pair of clutch linings 21 are disposed oppositely around the torque head 20. When an adjusting knob 22 on top of the torque head 20 is turned to the left or to the right, the clutch lining 21 will press the ratchet 13 on the wall, to make the torque head 20 respectively transfer the torque output in a clockwise or counter-clockwise direction, so as to tighten or to loosen the bolt.

A pivot tunnel 14 is in the shank 11. The tunnel 14 passes through the housing 12 of the wrench head 10. At the joint of the housing 12 of the wrench head 10 and the shank 11, an annulal cavity 15 is provided to accommodate the bevel gear 40.

Figure 3:
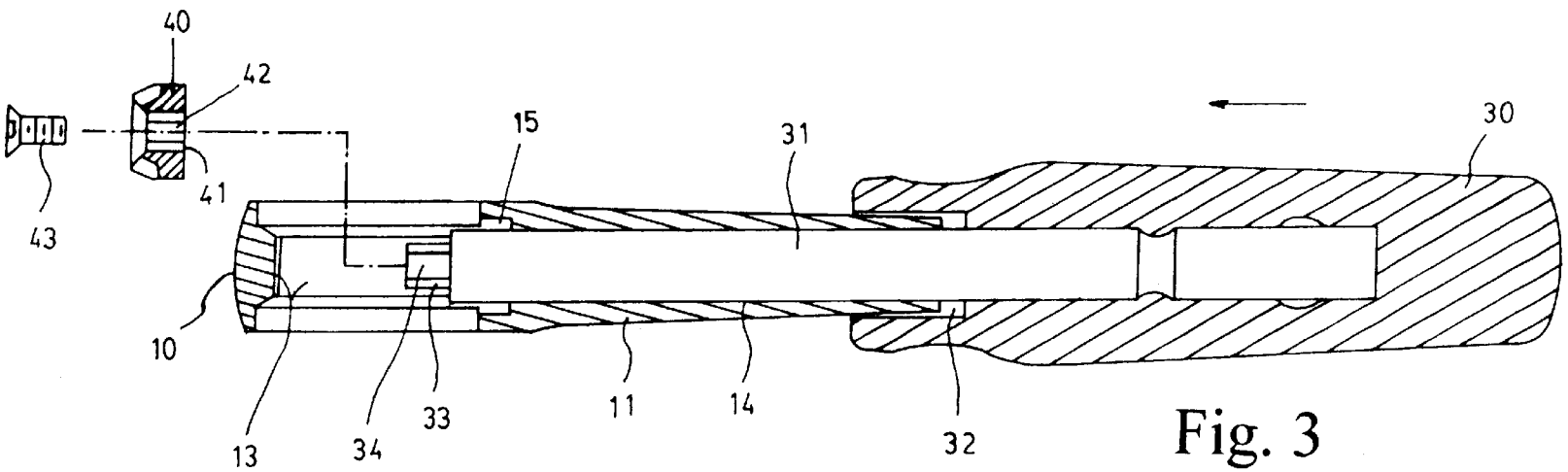
FIG. 3 is the disassembled of the bevel gear assembly.
Figure 5:
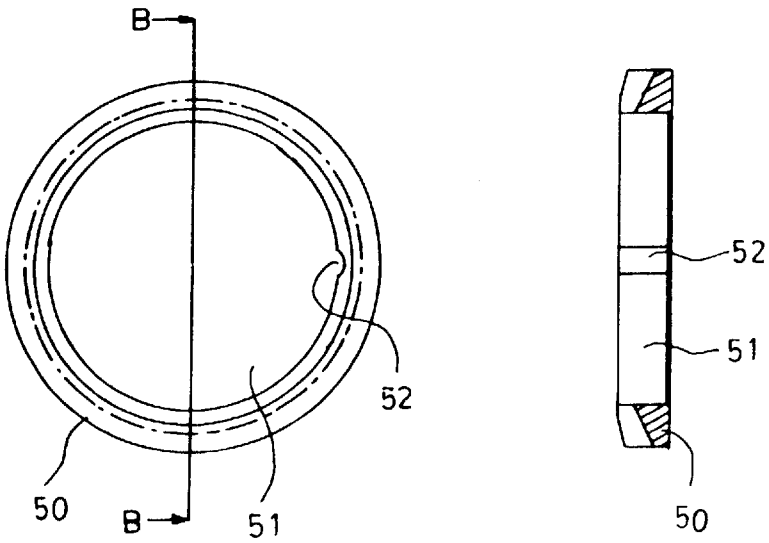
FIG. 5 is the outlook of the ring gear member of the torque transfer mechanism of the invention.
Figure 2:
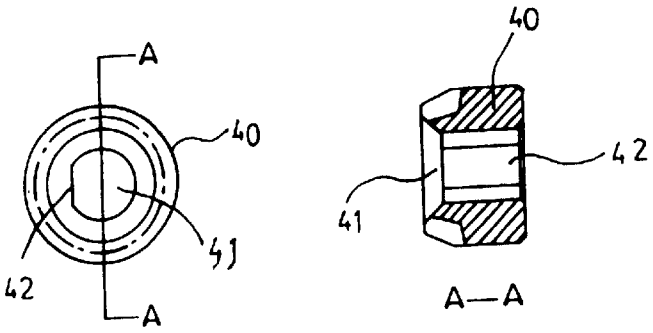
FIG. 2 is the outlook of the bevel gear member of the torque transfer mechanism of the invention.
Figure 4:
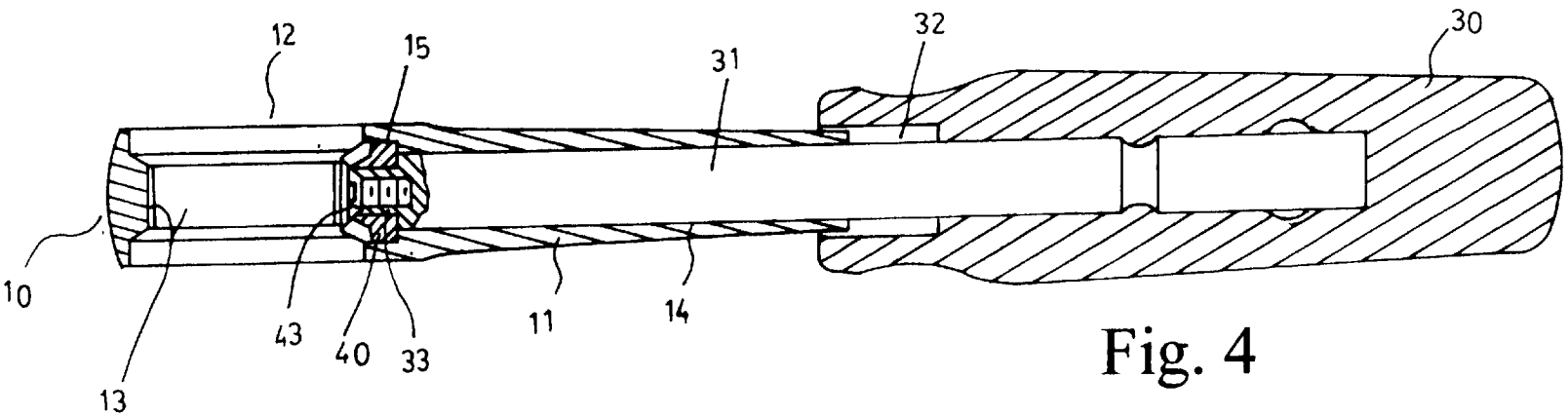
FIG. 4 is the bevel gear assembly housed in the interior of the handle.
Figure 6:
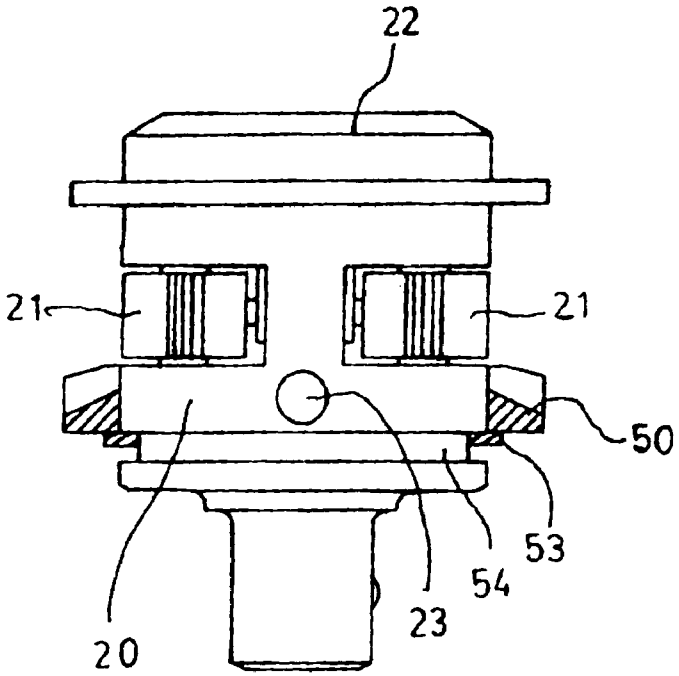
FIG. 6 is the combination of the bevel gear and the torque head.

A handle 30 is integrally molded with a rotary shaft 31. An adequate cushion groove 32 is formed between a front end of the handle 30 and the rotary shaft 31. The front end of the rotary shaft 31 has a protrusion 33, with a cut 34 disposed on the side of the protrusion 33. Bevel gear 40 is attached to the protrusion 33. As shown in FIG. 3, the rotary shaft 31 is adapted to slide in the pivot tunnel 14 in the shank 11 by pushing the handle 30. In turn, an end of the shank 11 will enter the cushion groove 32 in the handle 30, and the protrusion 33 and bevel gear 40 will move into the housing 12 of the wrench head 10, so as to place the protrusion in a position in which the bevel gear 40 may be locked in place. As shown in FIG. 4, after the bevel gear 40 is locked in place, pulling back the rotary shaft 31 will retreat the bevel gear 40 into the cavity 15.

The bevel gear 40 has a shaft hole 41 for receiving the protrusion 33. The hole 41 has a tongue member 42, which causes the hole to have a D-shape in cross-section. When the shaft hole 41 of the bevel gear 40 is sleeved onto the protrusion 33 of the rotary shaft, the tongue member 42 intimately contacts the cut 34 on the protrusion 33 to secure both firmly and to produce a synchronized action between the bevel gear 40 and the rotary shaft 31. The bevel gear 40 is tightened on the top of the protrusion 33 by a screw 43.

A ring gear 50 has a through shaft hole 51 and a clutch groove 52 formed in an inside wall. The wall of torque head 20 has a ball recess 23 that holds a retaining ball 24 in place. Part of the retaining ball 24 projects out of the wall of the torque head 20. When the torque head 20 is sleeved into the shaft hole 51 of the ring gear 50, the clutch groove 52 of the ring gear will sit on the exposed part of the retaining ball, so that by means of ball recess 23 and the clutch groove 52, the ring gear 50 and the torque head will act synchronically.

As shown in FIG. 1, the torque head 20 is inserted into the housing 12 of the wrench head 10, and the ring gear 50 is positioned around the torque head 20 in the housing 12. The torque head 20 is locked by sliding a C-clamp 53 into a clamp groove 54, so the torque head 20 and the ring gear 50 are secured firmly in the housing 12 of the wrench head 10. The ring gear 50 meshes perfectly with the bevel gear 40 which is constantly confined in the cavity 15 of the housing 12.

The practical operation of the socket wrench of the invention is described below:

When the adjusting knob 22 is turned, the clutch lining 21 will cause the torque head 20 to transfer a torque output in a clockwise or counterclockwise direction, when the shank 11 is reciprocated by swinging. However, prior to this, the handle 30 is not swung, but axially twisted, to cause rotary shaft 31 and the bevel gear 40 to axially rotate, to rotate the ring gear 50 and the torque head 20. At the moment when the bolt requires the maximum torque to tighten, the swing of the socket wrench is put in action. At this point, the adjusting knob is turned to set the clutch lining 21, so that a torque output can be achieved by swinging the handle 30.

From the above statement, the invention embraces the practicability and progresses as follows:

1. Without any modification on the fundamental structure of the prior art socket wrench, the invention provides another way of torque transfer for easily tightening a bolt.
2. The torque transfer mechanism is fast to fabricate, and easy to assemble, with minor additions of production cost for a few new parts.
3. The torque transfer mechanism employs the bevel gear meshing with the ring gear to achieve a stable and solid torque output.
4. The interior of the shank of the handle houses the bevel gear at the front end of a rotary shaft, making the combination robust and convenient.

Viewing from the above statement, it is understood that the invention has removed the shortfalls the prior art of the socket wrench cherishes, enhanced its efficiency and lifted its application value. It is therefore justified to apply a patent for this invention.

What is claimed is:

1. A torque transfer mechanism for a socket wrench, comprising:

a wrench head having a housing, a vertically-extending cavity formed in said housing, and a ratchet formed on an inside wall of said housing;

a torque head received within the cavity, and having an adjusting knob on a top thereof, and having a pair of clutch linings, said adjusting knob being selectively turnable in a clockwise and a counterclockwise direction, thereby causing a select one of said clutch linings to extend and engage said ratchet, to rotatably lock said torque head to said wrench head in a select one of the clockwise and the counterclockwise direction to thereby allow said socket wrench to produce a torque when said socket wrench is rotated in the select one of the clockwise and the counterclockwise direction, a wall of said torque head having a ball recess that holds a retaining ball in place, with a part of said retaining ball projecting outward beyond the wall;

a shank integrally formed with said wrench head and extending horizontally therefrom, said shank having a though tunnel that also extends through said housing, said shank having a cavity that surrounds the through tunnel in a region where the tunnel extends through said housing;

a handle having a front end, and a groove formed in the front end, a rear end of said shank being positioned in the groove;

a rotary shaft integrally formed with said handle and being disposed within the through tunnel, said rotary shaft being axially rotatable within the through tunnel and relative to said shank, said rotary shaft projecting from the front end of said handle and being surrounded by the groove in the front end of said handle, a front end of said rotary shaft having a protrusion that has a diameter that is less than a diameter of a remainder of said rotary shaft, said protrusion having a cut on a side thereof;

a bevel gear received within the cavity of said shank, and having a shaft hole, and a tongue member inside the shaft hole, said bevel gear being sleeved on said protrusion of said rotary shaft with the tongue member engaging with the cut so that said bevel gear and said rotary shaft are axially rotatable together; and a ring gear having a through hole, and a clutch groove formed on an inside wall thereof, said torque head being positioned in the through hole of said ring gear, with said retaining ball engaging the clutch groove so that said ring gear and said torque head are keyed together, and so that the ring gear and said torque head will axially rotate in a synchronized manner;

wherein said bevel gear is in constant meshing engagement with said ring gear; and wherein an axial rotation of said handle causes said rotary shaft and said bevel gear to axially rotate, to thereby cause said ring gear and said torque head to axially rotate relative to said housing.

* * * * *